US005468711A

United States Patent [19]

Suzuki et al.

[11] Patent Number: 5,468,711

[45] Date of Patent: Nov. 21, 1995

[54] INFORMATION RECORDING MEDIUM AND PRINTING METHOD USING THE SAME

[75] Inventors: Akira Suzuki; Yoshihiko Hotta, both of Mishima; Hiroyuki Uemura, Numazu, all of Japan

[73] Assignee: Ricoh Company, Ltd., Tokyo, Japan

[21] Appl. No.: 141,639

[22] Filed: Oct. 27, 1993

[30] Foreign Application Priority Data

Oct. 27, 1992 [JP] Japan ..... 4-311260

[51] Int. Cl.[6] ..... B41M 5/035; B41M 5/38

[52] U.S. Cl. ..... 503/201; 428/173; 428/195; 428/694 R; 428/913; 428/914; 503/227

[58] Field of Search ..... 428/173, 195, 428/913, 914, 694 R; 503/200, 201, 217, 225, 226, 227

[56] References Cited

U.S. PATENT DOCUMENTS

| | | | |
|---|---|---|---|
| 3,411,935 | 11/1968 | Winzer | 428/173 |
| 4,081,188 | 3/1978 | Wescott | 428/173 |
| 4,695,528 | 9/1987 | Dabisch | 430/290 |
| 5,001,106 | 3/1991 | Egashira et al. | 503/227 |
| 5,087,601 | 2/1992 | Hotta et al. | 503/200 |
| 5,158,924 | 10/1992 | Konagaya et al. | 503/201 |
| 5,158,926 | 10/1992 | Hotta et al. | 503/217 |
| 5,219,820 | 6/1993 | Morohoshi et al. | 503/204 |
| 5,283,220 | 2/1994 | Kawaguchi et al. | 503/200 |

*Primary Examiner*—B. Hamilton Hess

*Attorney, Agent, or Firm*—Oblon, Spivak, McClelland, Maier & Neustadt

[57] ABSTRACT

An information recording medium is composed of a support; a thermosensitive recording layer provided at least on one side of the support, the thermosensitive recording layer being composed of a matrix resin and an organic low-molecular-weight material which is dispersed in the matrix resin, the transparency of the thermosensitive recording layer being reversibly changeable depending upon the temperature thereof; and a thermal transfer image receiving layer for thermal printing thereon by thermal transfer recording, which is provided at least on one side of the support, opposite to the thermosensitive recording layer. A printing method using the above information recording medium is also provided.

The thermosensitive recording layer and the thermal transfer image receiving layer may be replaced by a single sublimable material receiving reversible thermosensitive recording layer which have the two functions of the thermosensitive recording layer and the thermal transfer image receiving layer.

30 Claims, 12 Drawing Sheets

INFORMATION RECORDING MEDIUM AND PRINTING METHOD USING THE SAME

BACKGROUND OF THE INVENTION

1. Field of the Invention

The present invention relates to an information recording medium such as a magnetic card, capable of temporarily displaying recorded information, and also relates to a printing method using the information recording medium.

2. Discussion of Background

In accordance with the recent rapid development and progress of techniques related to the transmission of information, such as Information Network System (INS) and Value Added Network (VAN), the value of information is increasing. In accordance with this trend, hard copies for displaying information are required apart from information processing apparatus and equipment because such information processing apparatus and equipment in general use do not have a function of displaying an information transmission method, and an information memory and display.

For instance, in the case of a cash dispenser to be used with cash cards, when the user deposits or withdraws his money, using the cash dispenser, a hard copy showing the balance is separately output. In the case of other cards such, as credit cards, the cards themselves do not have a display function. Therefore, separate hard copies are required for showing the contents of the use of the cards.

Under such circumstances, there is a growing demand for a card having a displaying function.

In order to meet this demand, there has been proposed a multi-function card which can be also used as a calculator by modifying an I.C. card with the provision of a liquid display or with a built-in battery to impart a display function thereto. However, such a multi-function card with a display is not necessarily handy because a battery is required and the card itself is costly.

SUMMARY OF THE INVENTION

It is therefore a first object of the present invention to provide an information recording medium provided with a display function which is capable of repeatedly recording information, displaying recorded information in a full color with high contrast, which cannot be easily erased by friction when the information is necessary and displayed, but can be erased promptly when the recorded information becomes unnecessary.

A second object of the present invention is to provide an information recording medium which has the above-mentioned functions and is capable of carrying out the above functions inexpensively.

A third object of the present invention is to provide a printing method by use of the above-mentioned information recording medium.

The first and second objects of the present invention can be achieved by an information recording medium comprising a support a thermosensitive recording layer provided at least on one side of the support, the thermosensitive recording layer comprising a matrix resin and an organic low-molecular-weight material which is dispersed in the matrix resin, the transparency of the thermosensitive recording layer being reversibly changeable depending upon the temperature thereof; and a thermal transfer image receiving layer for thermal printing thereon by thermal transfer recording, which is provided at least on one side of the support.

The first and second objects of the present invention can also be achieved by an information recording medium comprising a support; a thermosensitive recording layer supported on a film which is applied to at least one side of the support, the thermosensitive recording layer comprising a matrix resin and an organic low-molecular-weight material which is dispersed in the matrix resin, the transparency of the thermosensitive recording layer being reversibly changeable depending upon the temperature thereof, and a thermal transfer image receiving layer for thermal printing thereon by thermal transfer recording, which is supported on a film applied to at least one side of the support.

The first and second objects of the present invention can also be achieved by an information recording medium comprising a support; and a sublimable material receiving reversible thermosensitive recording layer provided at least on one side of the support, the sublimable material receiving reversible thermosensitive recording layer comprising (a) a matrix resin having a function of receiving a thermosensitive sublimable material, and (b) an organic low-molecular-weight material which is dispersed in the matrix resin, the transparency of the thermosensitive recording layer being reversibly changeable depending upon the temperature thereof.

In the above information recording medium, it is preferable that the matrix resin be a vinyl-chloride-based resin.

In the above-mentioned information recording media of the present invention, a colored layer or a light reflection layer can be provided between the thermosensitive recording layer and the support, in a portion right under the thermosensitive recording layer, or on the back side of the support, opposite to the thermosensitive recording layer with respect to the support, in a portion under the thermosensitive recording layer, if necessary, through an adhesive layer.

The colored layer or the light reflection layer can be provided between the thermosensitive recording layer and the support, or on the back side of the support, opposite to the thermosensitive recording layer with respect to the support, in a portion under the thermosensitive recording layer, through an adhesive layer which includes a vacant non-adhesive portion through which the colored layer or the light reflection layer can be seen from the side of the thermosensitive recording layer.

Any of the above-mentioned information recording media of the present invention may further comprise a magnetic recording layer on part of at least one side of the support thereof.

Any of the above-mentioned information recording medium of the present invention may further comprise an IC recording portion on part of at least one side of the support or within the support.

In any of the above-mentioned information recording media of the present invention, the thermosensitive recording layer may further comprise a releasing agent.

Any of the above-mentioned information recording media of the present invention may further comprise a releasing layer or a protective layer which is provided on the thermosensitive recording layer.

In any of the above-mentioned information recording media of the present invention, the support may include a concave portion on at least one side thereof in which the thermosensitive recording layer or the thermosensitive recording layer supported by the film is provided.

The third object of the present invention can be achieved by a printing method of printing a sublimation transfer image and a milky-white image on any of the above-mentioned information recording media of the present invention, which includes the colored layer or the light reflection layer, comprising the steps of:

superimposing a sublimation thermal image transfer recording sheet on the thermal transfer image receiving layer of the information recording medium;

applying head imagewise to the sublimation thermal image transfer recording sheet, thereby printing a sublimation transfer image on the thermal transfer image receiving layer, and applying heat imagewise to a portion of the thermosensitive recording layer above the colored layer or the light reflection layer, thereby printing a milky-white image on the portion of the thermosensitive recording layer.

In the above printing method of the present invention, the milky-white image may be repeatedly printed or erased by the application of heat to the portion of the thermosensitive recording layer.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 8(*b*) is a schematic cross-sectional view of a thermal transfer image receiving member for use in the present invention.

FIG. 15(*b*) is a schematic cross-sectional view of another example of a sublimable material receiving reversible thermosensitive recording layer member for use in the present invention.

DESCRIPTION OF THE PREFERRED EMBODIMENTS

Specific examples of an information recording medium of the present invention will now be explained with reference to the accompanying drawings.

Figure 2A:
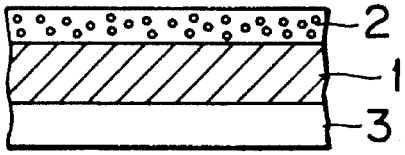
FIG. 2(*a*) through FIG. 7(*b*) are schematic cross-sectional viess of examples of an information recording medium of the present invention.
Figure 2B:
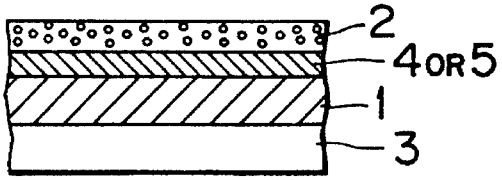

FIG. 2(*a*) is a schematic cross-sectional view of an information recording medium No. 1 of the present invention, which comprises a support 1, a reversible thermosensitive recording layer 2 which is provided on one side of the support 1, and a thermal transfer image receiving layer 3 which is provided on the other side of the support 1, opposite to the reversible thermosensitive recording layer 2 with respect to the support 1.

FIG. 2(*b*) is a schematic cross-sectional view of an information recording medium No. 2 of the present invention, which comprises a support 1, a colored layer 4 or a light reflection layer 5, for instance, an aluminum-deposited layer, which is provided on one side of the support 1, a reversible thermosensitive recording layer 2 which is provided on the colored layer 4 or on the light reflection layer 4, and a thermal transfer image receiving layer 3 which is provided on the other side of the support 1, opposite to the reversible thermosensitive recording layer 2 with respect to the support 1.

Figure 3A:
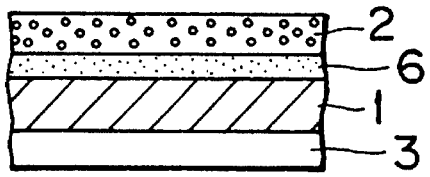
Figure 3B:
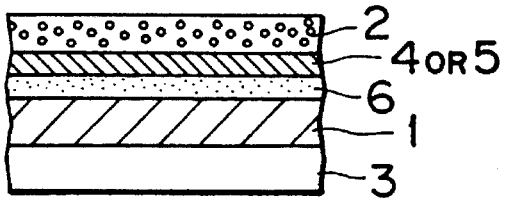

FIG. 3(*a*) is a schematic cross-sectional view of an information recording medium No. 3 of the present invention, which comprises a support 1, a magnetic recording layer 6 provided on at least part of one side of the support 1, a reversible thermosensitive recording layer 2 which is provided on the same side of the support 1 as the magnetic recording layer 6 is provided, or on the magnetic recording layer 6, and a thermal transfer image receiving layer 3 which is provided on the other side of the support 1, opposite to the reversible thermosensitive recording layer 2 with respect to the support 1.

FIG. 3(*b*) is a schematic cross-sectional view of an information recording medium No. 4 of the present invention, which is the same as the information recording medium No. 3 shown in FIG. 3(*a*) except that a colored layer 4 or a light reflection layer 5 is provided at least under the reversible thermosensitive recording layer 2.

Figure 4A:
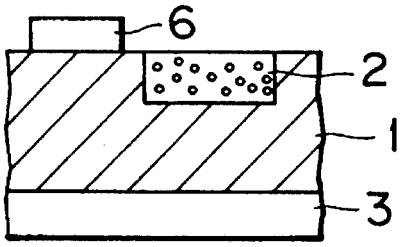
Figure 4B:
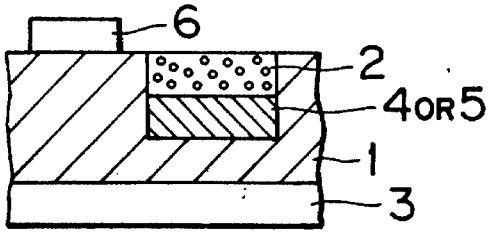

FIG. 4(*a*) is a schematic cross-sectional view of an information recording medium No. 5 of the present invention, which comprises a support 1 with a concave portion formed on one side of the support 1, a reversible thermosensitive recording layer 2 provided in the concave portion, a magnetic recording layer 6 provided on the same side of the support 1 as the reversible thermosensitive recording layer 2 is provided, but at least in a portion on the support 1 except the portion where the reversible thermosensitive recording layer 2 is provided, and a thermal transfer image receiving layer 3 which is provided on the other side of the support 1, opposite to the reversible thermosensitive recording layer 2 with respect to the support 1.

FIG. 4(*b*) is a schematic cross-sectional view of an information recording medium No. 6 of the present invention, which is the same as the information recording medium No. 5 shown in FIG. 4(*a*) except that a colored layer 4 or a light reelection layer 5, for instance, an aluminum-deposited layer, is provided at least under the reversible thermosensitive recording layer 2.

Figure 5A:
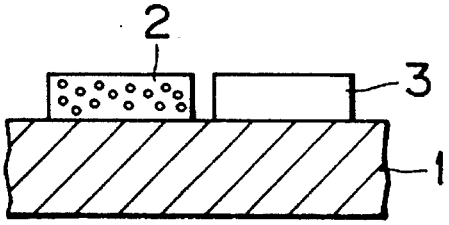
Figure 5B:
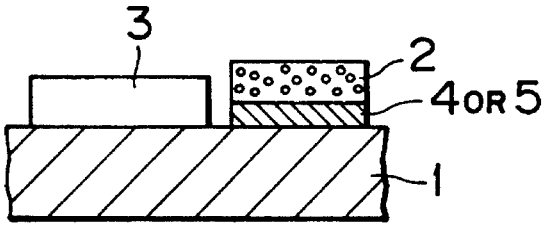

FIG. 5(*a*) is a schematic cross-sectional view of an information recording medium No. 7 of the present invention, which comprises a support 1, a reversible thermosensitive recording layer 2 provided on part of one side of the support 1, and a thermal transfer image receiving layer 3 which is provided on part of the same side of the support as the reversible thermosensitive recording layer 2 is provided.

FIG. 5(*b*) is a schematic cross-sectional view of an information recording medium No. 8 of the present invention, which is the same as the information recording medium No. 7 shown in FIG. 5(*a*) except that a colored layer 4 or a light reflection layer 5 is provided at least under the reversible thermosensitive recording layer 2.

Figure 6A:
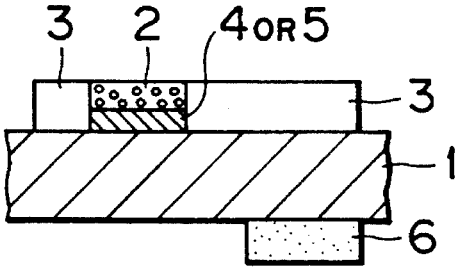
Figure 6B:
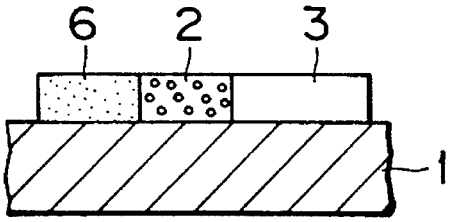

FIG. 6(*a*) is a schematic cross-sectional view of an information recording medium No. 9 of the present invention, which comprises a support 1, a reversible thermosensitive recording layer 2 provided on one side of the support 1, with a colored layer 4 or a light reflection layer 5 being provided under the reversible thermosensitive recording layer 2, a thermal transfer image receiving layer 3 provided on the same side of the support 1 as the reversible thermosensitive recording layer 2 is provided, and a magnetic recording layer 6 provided on the back side of the support 1, opposite to the reversible thermosensitive recording layer 2 and the thermal transfer image receiving layer 3 with respect to the support 1.

FIG. 6(*b*) is a schematic cross-sectional view of an information recording medium No. 10 of the present invention, which comprises a support 1, a reversible thermosensitive recording layer 2 provided on one side of the support 1, a thermal transfer image receiving layer 3 provided on the same side of the support 1 as the reversible thermosensitive recording layer 2 is provided, and a magnetic recording layer 6 which is also provided on the same side of the support 1 as the reversible thermosensitive recording layer 2 is provided.

Figure 7A:
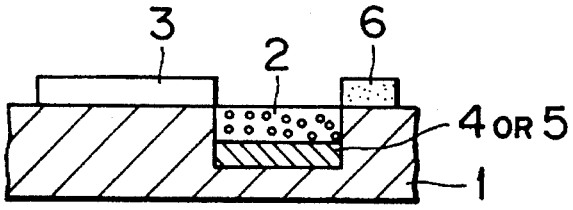
Figure 7B:
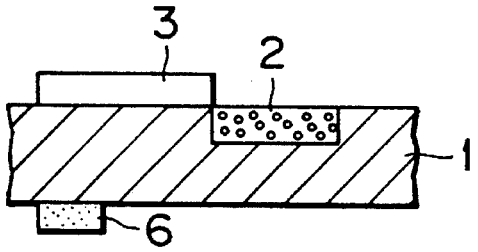

FIG. 7(*a*) is a schematic cross-sectional view of an information recording medium No. 11 of the present invention, which comprises a support 1 with a concave portion on one side of the support 1, a reversible thermosensitive recording layer 2 which is provided in the concave portion, with a colored layer 4 or a light reflection layer 5 being provided under the reversible thermosensitive recording layer 2, a thermal transfer image receiving layer 3 provided on the same side of the support 1 as the reversible thermosensitive recording layer 2 is provided, and a magnetic recording layer 6 which is also provided on the same side of the support 1 as the reversible thermosensitive recording layer 2 is provided.

FIG. 7(*b*) is a schematic cross-sectional view of an information recording medium No. 12 of the present invention, which comprises a support 1 with a concave portion on one side of the support 1, a reversible thermosensitive recording layer 2 which is provided in the concave portion, a thermal transfer image receiving layer 3 provided on the same side of the support 1 as the reversible thermosensitive recording layer 2 is provided, and a magnetic recording layer 6 which is provided on the back side of the support 1, opposite to the reversible thermosensitive recording layer 2 and the thermal transfer image receiving layer 3 with respect to the support 1.

Figure 8A:
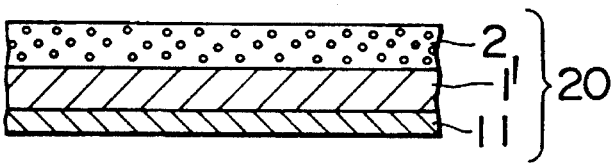
FIG. 8(*a*) is a schematic cross-sectional view of a reversible thermosensitive recording member for use in the present invention.
Figure 8B:
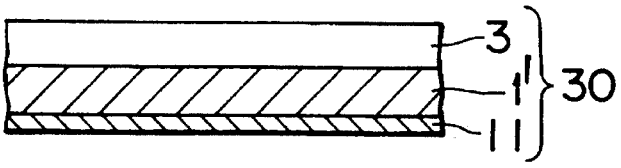

FIG. 8(*a*) is a schematic cross-sectional view of a reversible thermosensitive recording member 20 comprising a support film 1', a reversible thermosensitive recording layer 2 provided on one side of the support film 1', and an adhesive layer 11 provided on the other side of the support film 1', opposite to the reversible thermosensitive recording layer 2 with respect to the support film 1'.

FIG. 8(*b*) is a schematic cross-sectional view of a thermal transfer image receiving member 30 comprising a support film 1', a thermal transfer image receiving layer 3 provided on one side of the support film 1', and an adhesive layer 11 provided on the other side of the support film 1', opposite to the thermal transfer image receiving layer 3 with respect to the support film 1'.

Figure 9:
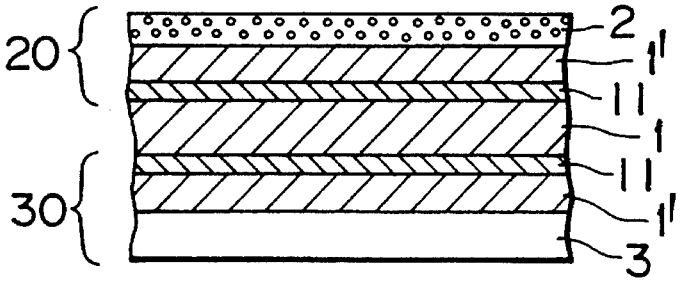
FIG. 9 to FIG. 14(*b*) are schematic cross-sectional views of examples of an information recording medium of the present invention.

FIG. 9 is a schematic cross-sectional view of an information recording medium No. 13 of the present invention which comprises a support 1, the reversible thermosensitive recording member 20 shown in FIG. 8(*a*) which is applied to one side of the support 1, and the thermal transfer image receiving member 38 shown in FIG. 8(*b*) which is applied to the back side of the support 1, opposite to the reversible thermosensitive recording member 20 with respect to the support 1.

Figure 10:
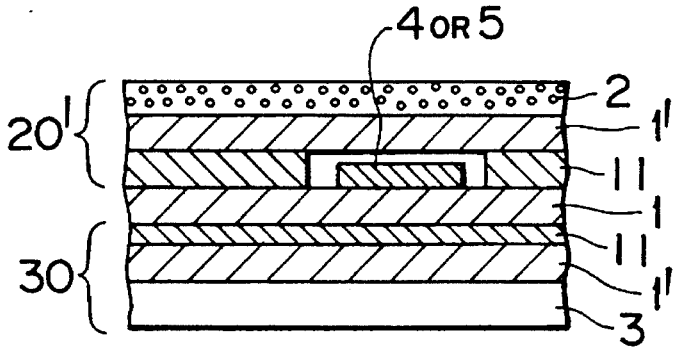

FIG. 10 is a schematic cross-sectional view of an information recording medium No. 14 of the present invention which comprises a support 1, a reversible thermosensitive recording member 20' applied to one side of the support 1, the reversible thermosensitive recording member 20' being the same as the reversible thermosensitive recording member 20 shown in FIG. 8(*a*) except that a colored layer 5 or a light reflection layer 5 is provided in a vacant non-adhesive portion formed in the adhesive layer 11, under the reversible thermosensitive recording layer 2, and the thermal transfer image receiving member 30 shown in FIG. 8(*b*) applied to the back side of the support 1, opposite to the reversible thermosensitive recording member 20' with respect to the support 1.

Figure 11:
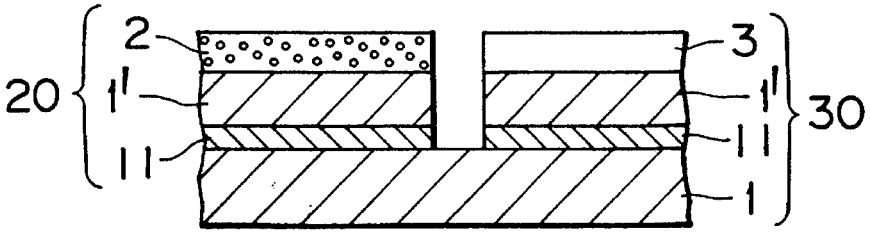

FIG. 11 is a schematic cross-sectional view of an information recording medium No. 15 of the present invention which comprises a support 1, the reversible thermosensitive recording member 20 shown in FIG. 8(*a*) which is applied to one side of the support 1, and the thermal transfer image receiving member 30 shown in FIG. 8(*b*) which is applied to the same side of the support 1 as the reversible thermosensitive recording member 20 is provided.

Figure 12A:
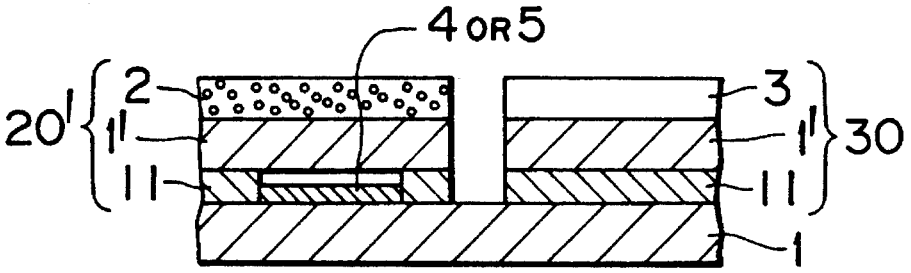
Figure 12B:
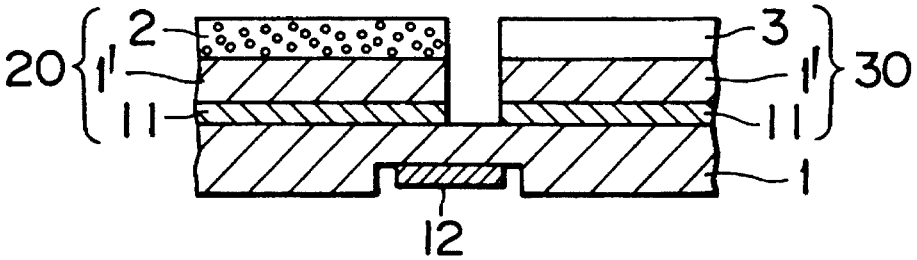

FIG. 12(*a*) is a schematic cross-sectional view of an information recording medium No. 16 of the present invention which comprises a support 1, the reversible thermosensitive recording member 20' shown in FIG. 10 which is applied to one side of the support 1, and the thermal transfer image transfer receiving member 30 shown in FIG. 8(*b*) which is applied to the same side of the support 1 as the reversible thermosensitive recording member 20 is provided.

FIG. 12(*b*) is a schematic cross-sectional view of an information recording medium No. 17 of the present invention which comprises a support 1 with a concave portion at the back side thereof in which an IC recording portion 12 is provided, the reversible thermosensitive recording member 20 shown in FIG. 8(*a*) which is applied to one side of the support 1, and the thermal transfer image receiving member 30 shown in FIG. 8(*b*) which is applied to the same side of the support 1 as the reversible thermosensitive recording member 20 is provided.

Figure 13:
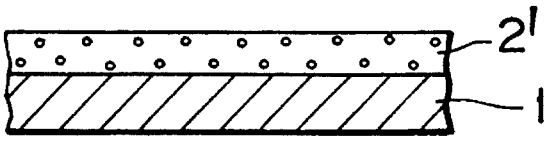

FIG. 13 is a schematic cross-sectional view of an information recording medium No. 18 of the present invention which comprises a support 1 and a reversible thermosensitive recording layer 2' having a function of receiving a thermosensitive sublimable material, which is provided on one side of the support 1. Hereinafter this recording layer 2' is referred to as the sublimable material receiving reversible thermosensitive recording layer 2'.

Figure 14A:
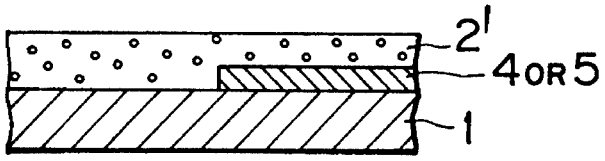
Figure 14B:
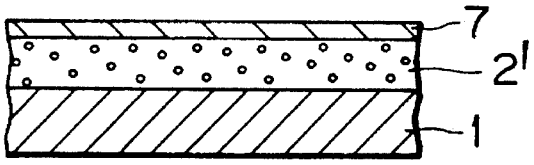

FIG. 14(*a*) is a schematic cross-sectional view of an information recording medium No. 19 of the present invention which comprises a support 1 and a sublimable material receiving reversible thermosensitive recording layer 2', which is provided on one side of the support 1, with a colored layer 4 or a light reflection layer 5 being provided between the sublimable material receiving reversible thermosensitive recording layer 2' and the support 1.

FIG. 14(*b*) is a schematic cross-sectional view of an information recording medium No. 20 of the present invention which comprises a support 1, a sublimable material receiving reversible thermosensitive recording layer 2', which is provided on one side of the support 1, and a releasing layer 7 which is provided on the sublimable material receiving reversible thermosensitive recording layer 2'.

Figure 15A:
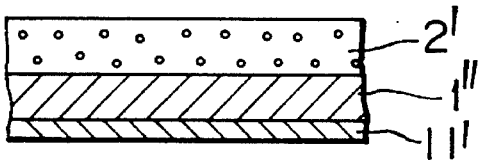
FIG. 15(*a*) is a schematic cross-sectional view of an example of a sublimable material receiving reversible thermosensitive recording layer member for use in the present invention.
Figure 15B:
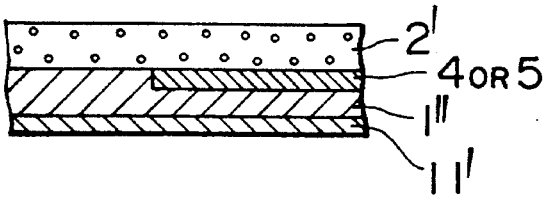

FIG. 15(*a*) is a schematic cross-sectional view of a sublimable material receiving reversible thermosensitive recording layer member for use in the present invention which comprises a transparent support 1", a sublimable material receiving reversible thermosensitive recording layer 2' which is provided on one side of the support 1", and an adhesive layer 11' which is provided on the back side of the transparent support 1", opposite to the sublimable material receiving reversible thermosensitive recording layer 2' with respect to the transparent support 1".

FIG. 15(*b*) is a schematic cross-sectional view of a sublimable material receiving reversible thermosensitive recording layer member for use in the present invention which comprises a transparent support 1", a sublimable material receiving reversible thermosensitive recording layer 2' which is provided on one side of the transparent support 1", a colored layer 4 or a light reflection layer 5 which is provided right under the sublimable material receiving reversible thermosensitive recording layer 2', between the recording layer 2' and the transparent support 1" and an adhesive layer 11' which is provided on the back side of the transparent support 1", opposite to the sublimable material receiving reversible thermosensitive recording layer 2' with respect to the transparent support 1".

Figure 16A:
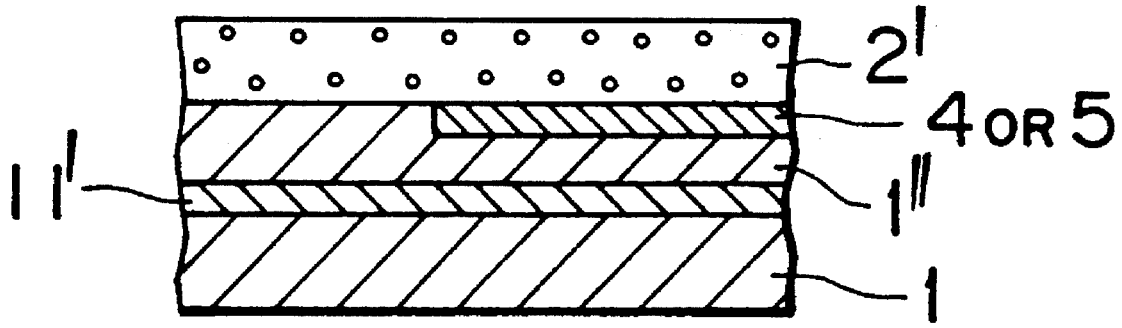
FIG. 16(*a*) to FIG. 18(*d*) are schematic cross-sectional views of examples of an information recording medium of the present invention.
Figure 16B:
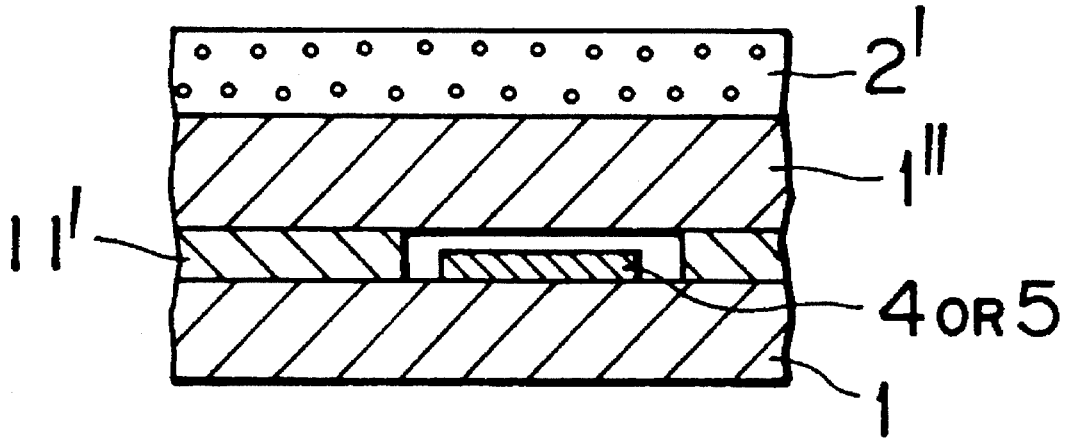
Figure 17A:
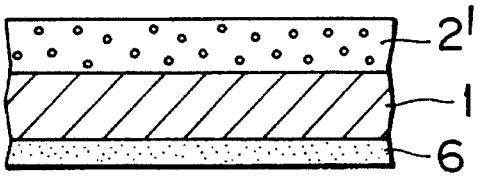
Figure 17B:
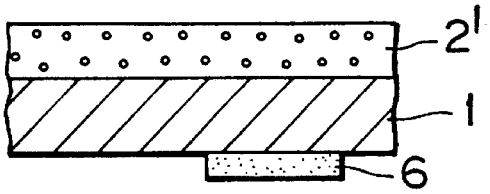
Figure 17C:
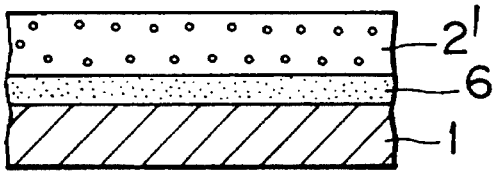
Figure 17D:
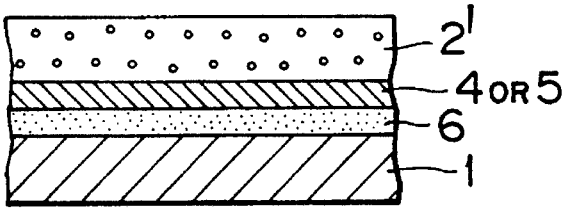
Figure 18A:
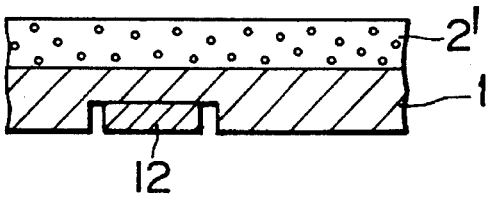
Figure 18B:
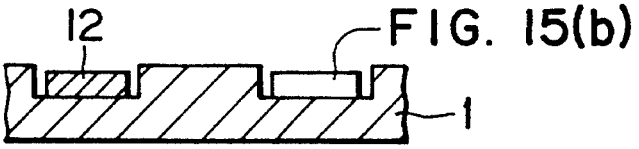
Figure 18C:
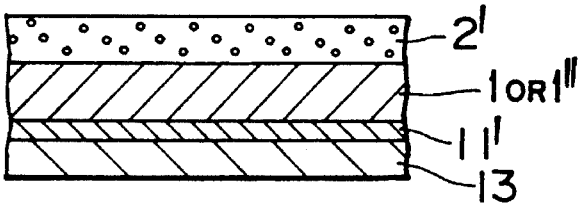
Figure 18D:
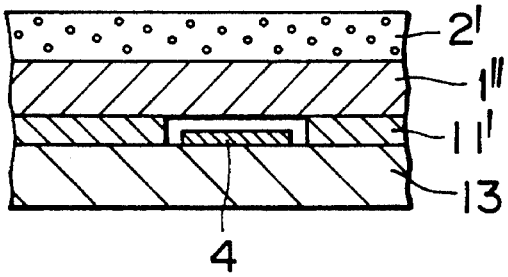

FIG. 16(*a*) is a schematic cross-sectional view of an information recording medium No. 21 of the present invention, which comprises a support 1 and the sublimable material receiving reversible thermosensitive recording layer member shown in FIG. 15(*b*) which is applied to the support 1.

FIG. 16(*b*) is a schematic cross-sectional view of an information recording medium No. 22 of the present invention, which is the same as the information recording medium No. 21 except that the colored layer 4 or the light reflection layer 5 is provided in a vacant non-adhesive portion formed in the adhesive layer 11'.

FIG. 17(*a*) is a schematic cross-sectional view of an information recording medium No. 23 of the present invention which comprises a support 1, a sublimable material receiving reversible thermosensitive recording layer 2' which is provided on one side of the support 1, and a magnetic recording layer 6 which is provided on the back side of the support 1, opposite to the recording layer 2' with respect to the support 1.

FIG. 17(*b*) is a schematic cross-sectional view of an information recording medium No. 24 of the present invention which comprises a support 1, a sublimable material receiving reversible thermosensitive recording layer 2' which is provided on one side of the support 1, and a magnetic recording layer 6 which is provided on part of the back side of the support 1, opposite to the recording layer 2' with respect to the support 1.

FIG. 17(*c*) is a schematic cross-sectional view of an information recording medium No. 25 of the present invention which comprises a support 1, a magnetic recording layer 6 which is provided on one side of the support 1, and a sublimable material receiving reversible thermosensitive recording layer 2' which is provided on the magnetic recording layer 6.

FIG. 17(*d*) is a schematic cross-sectional view of an information recording medium No. 26 of the present invention, which is the same as the information recording medium No. 25 shown in FIG. 17(*c*) except that a colored layer 4 or a light reflection layer 5 is interposed between the magnetic recording layer 6 and the sublimable material receiving reversible thermosensitive recording layer 2'.

The portion of the information recording medium No. 18 shown in FIG. 13, which is employed in the information recording media Nos. 23 to 26, respectively shown in FIGS. 17(*a*) to 17(*d*), can be replaced by the portion of the information recording medium No. 19 shown in FIG. 14(*a*) or by the portion of the information recording medium No. 20 shown in FIG. 14(*b*).

FIG. 18(*a*) is a schematic cross-sectional view of an information recording medium No. 27 of the present invention, which is the same as the information recording medium No. 18 shown in FIG. 13 except that the support 1 has a concave portion on the back side thereof, opposite to the sublimable material receiving reversible thermosensitive recording layer 2' with respect to the support 1, and an IC recording portion 12 is provided in the concave portion of the support 1.

FIG. 18(*b*) is a schematic cross-sectional view of an information recording medium No. 28 of the present invention, which comprises a support 1 with two concave portions on one side thereof, the sublimable material receiving reversible thermosensitive recording layer member shown in FIG. 15(*b*), which is provided in one of the concave portions of the support 1, and an IC recording portion 12 which is provided in the other concave portion of the support 1.

FIG. 18(*c*) is a schematic cross-sectional view of an information recording medium No. 29 of the present invention, which comprises an IC card 13 and the information recording medium No. 18 shown in FIG. 13 which is applied to the IC card 13 through an adhesive layer 11'. The support 1 employed in the information recording medium No. 29 may be replaced by a transparent support 1".

FIG. 18(*d*) is a schematic cross-sectional view of an information recording medium No. 30 of the present invention, which is the same as the information recording medium No. 29 shown in FIG. 18(*c*) except that the support 1 employed therein is replaced by the transparent support 1', and that the adhesive layer 11' includes a vacant non-adhesive portion, in which a colored layer 4 or a light reflection layer 5 is provided.

The colored layer 4 or the light reflection layer 5 is provided in order to make more easily visible the images displayed on the reversible thermosensitive recording layer 2 or on the sublimable material receiving reversible thermosensitive recording layer 2'.

The printing energy required for thermosensitive sublimation image transfer recording method is two or three times the printing energy required for the reversible thermosensitive recording method, so that the problems such as the sticking between a sublimation ink sheet and a thermal head, and the breaking of the ink sheet by the thermal head may occur. In order to eliminate such problems, it is preferable that a releasing agent such as silicone oil be contained in the thermosensitive recording layer, or that a releasing layer be provided on the thermosensitive recording layer, thereby obtaining clear sublimation image transfer images.

In the information recording media No. 5 and No. 6, which are respectively shown in FIG. 4(*a*) and FIG. 4(*b*), and the information recording media No. 11 and No. 12, which are respectively shown in FIG. 7(*a*) and FIG. 7(*b*), each of which is provided with the magnetic recording layer 6, the reversible thermosensitive recording layer 2 is provided in the concave portion formed in the support 1, so that the top surface of the reversible thermosensitive recording layer 2 is at the same level as that of the support 1. Therefore, such information recording media, particularly in the case of card-shaped media, are free from the problems of improper running and abrasion of the reversible thermosensitive recording layer 2 through a recording and reading apparatus, during the magnetic recording or reading thereof.

Furthermore, the reversible thermosensitive recording member 20 shown in FIG. 8(*a*) and the thermal transfer image receiving member 30 as shown in FIG. 8(*b*), and the sublimable material receiving reversible thermosensitive recording layer members shown in FIG. 15(*a*) and FIG. 15(*b*), each of which is provided with the adhesive layer 11 or 11', can be used as a label sheet for the fabrication of information recording media.

As the matrix resin for use in the reversible thermosensitive recording layer for the information recording medium of the present invention, vinyl-chloride-based resins ere particularly useful, because vinyl-chloride-based resins have high thermosensitive reversibility, and high sublimable material receiving performance, so that the resins can be used in both the reversible thermosensitive recording layer and the thermal transfer image receiving layer for receiving a sublimable material.

The following TABLE 1 shows a variety of resins and the thermosensitive recording performance and thermosensitive sublimable material receiving performance. This table indicates that vinyl-chloride-based resins have excellent thermosensitive recording performance as well as excellent thermosensitive sublimable material receiving performance.

In TABLE 1, "◎" denotes "excellent", "o" denotes "good", "Δ" denotes "usable", and "x" denotes "no good".

TABLE 1

| Polymer | Thermo-sensitive Reversi-bility | Thermo-sensitive Sublimable Material Receiving Performance |
|---|---|---|
| Vinyl chloride resin (Polyvinyl chloride (Trademark "Aldrich Reagent" made by Aldrich Japan Inc.)) | o | ◎ |
| Vinyl chloride - vinyl acetate copolymer (Trademark "VYHH" made by Union Carbide Japan K.K.) | ◎ | ◎ |
| Chlorinated vinyl chloride resin (Trademark "Kaneka H-428" made by KANEBO, LTD.) | ◎ | ◎ |
| Phenoxy resin | o | Δ |
| Polycarbonate (Trademark "Panlite 1225" made by TEIJIN LIMITED) | Δ | Δ |

TABLE 1-continued

| Polymer | Thermo-sensitive Reversi-bility | Thermo-sensitive Sublimable Material Receiving Performance |
|---|---|---|
| Polystyrene (Trademark "SAN-L" made by Mitsubishi Monsanto Chemical Co.) | x | Δ |
| Silicone resin | Δ | x |
| Acrylic resin (Trademark "BR-85" made by Mitsubishi Rayon Engineering Co., Ltd.) | x | x |
| Polyamide (Trademark "CM-8000" made by Toray Industries, Inc.) | x | x |
| Polyvinyl butyral (Trademark "BX-1" made by Sakisui Chemical Co., Ltd.) | x | Δ |
| Cellulose acetate butyrate (Trademark "CAB 551-0.01" made by Kodak Japan K.K.) | x | x |
| Epoxy resin (Trademark "Epitote 1009"made by Yuka Shell Epoxy K.K.) | o | Δ |
| Polyester resin (Trademark "V200" made by TOYOBO CO., LTD.) | o–Δ | ◎ |
| Acetal resin (Vinyl acetate based) (Trademark "BL-3" made by Sekisui Chemical Co.. Ltd.) | x | x |
| Polyvinylidene chloride (Trademark "F-216" made by Asahi-Dow Limited) | x | o |
| Polyurethane resin (Trademark "P22S" made by NIPPON POLYURETHANE INDUSTRY CO., LTD.) | x | ◎ |
| Ethyl cellulose (Reagent) | x | Δ |

In the reversible thermosensitive recording layer for use in the information recording medium of the present invention, the property of changing the transparency from a transparent state to a white opaque or milky white state depending on the temperature thereof is utilized. The difference between the transparent state and the white opaque state of the reversible thermosensitive recording layer 2 is considered to be based on the following principle:

(i) In the transparent state, the organic low-molecular-weight material dispersed in the matrix resin consists of relatively large crystals, so that the light which enters the crystals from one side passes therethrough to the opposite side, without being scattered, thus the reversible thermosensitive recording layer 2 appears transparent.

(ii) In the milky white opaque state, the organic low-molecular-weight material is composed of polycrystals consisting of numerous small crystals, with the crystallographic axis pointed to various directions, so that the light which enters the recording layer is scattered a number of times at the interfaces of the crystals of the organic low-molecular-weight material. As a result, the thermosensitive recording layer 3 becomes opaque in a milky white color.

The transition of the state of the reversible thermosensitive recording layer 2 depending on the temperature thereof will now be explained by referring to FIG. 1.

Figure 1:
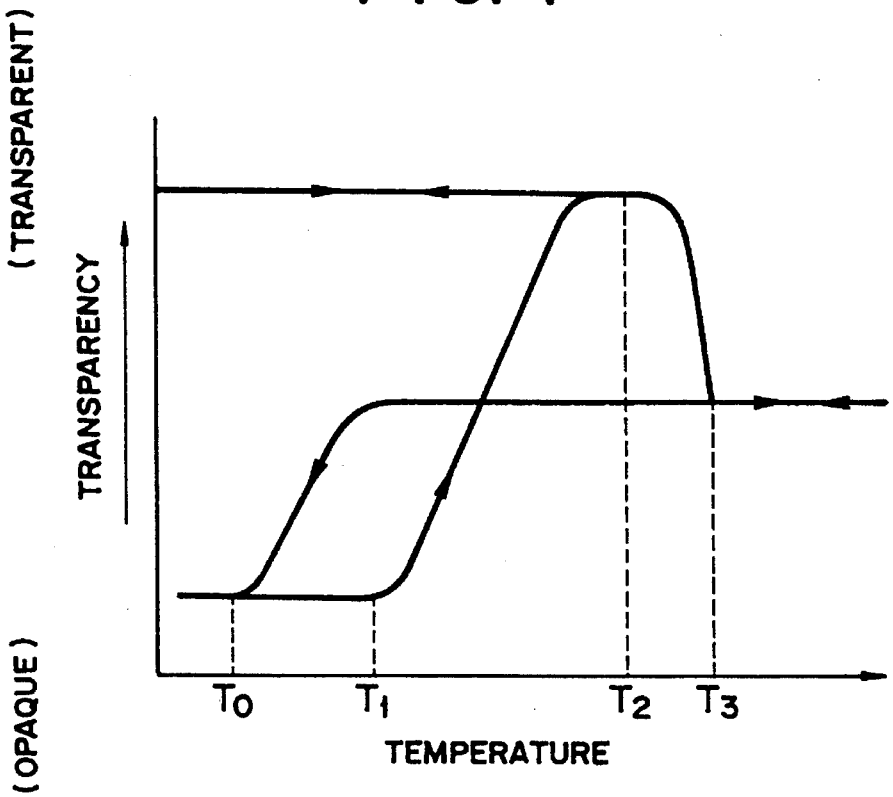
FIG. 1 is a diagram showing the temperature-dependent changes in the transparency of a reversible thermosensitive recording material for use in the present invention.

In FIG. 1, it is supposed that the reversible thermosensitive recording layer comprising a matrix resin and an organic low-molecular-weight material dispersed in the matrix resin is initially in a milky white opaque state at room temperature $T_0$ or below. When the thermosensitive recording layer is heated to temperature $T_2$, the thermosensitive recording layer becomes transparent. Thus, the recording layer reaches a maximum transparent state at temperature $T_2$. Even if the recording layer which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording layer in the maximum transparent state is further heated to temperature $T_3$ or more, it assumes a medium state which is between the maximum transparent state and the maximum milky white opaque state. When the recording layer in the medium state at temperature $T_3$ or more is cooled to room temperature $T_0$ or below, the recording layer returns to the original maximum opaque state, without passing through any transparent state. It is considered that this is because the organic low-molecular-weight material is melted when heated to temperature $T_3$ or above, and the polycrystals of the organic low-molecular-weight material grow and separate out when it is cooled. If the recording layer in the milky white opaque state is heated to any temperature between temperature $T_1$ and temperature $T_2$, and then cooled to room temperature $T_0$ or below, the recording layer assumes an intermediate state between the transparent state and the milky white opaque state.

When the recording layer in the transparent state at room temperature $T_0$ is again heated to temperature $T_3$ or above, end then cooled to room temperature $T_0$, the recording layer returns to the milky white opaque state. Thus, the reversible thermosensitive recording layer can assume a milky white maximum opaque staten, a maximum transparent state and an intermediate state between the aforementioned two states at room temperature.

To form the reversible thermosensitive recording layer on the support, (1) a solution in which both the matrix resin and the organic low-molecular-weight material are dissolved, or a dispersion prepared by dispersing the finely-divided particles of the organic low-molecular-weight material in a matrix resin solution may be coated on the support, then dried, so that the reversible thermosensitive recording layer can be formed on the support. The aforementioned matrix resin dispersion of the low-molecular-weight material employs a solvent in which the low-molecular-weight material can not be dissolved. Alternatively, (2) the matrix resin and the organic low-molecular-weight material are kneaded in the presence or absence of a solvent, when necessary, with the application of heat, and formed in the form of a sheet so that it is employed as a thermosensitive recording sheet in itself.

The solvent used for the formation of the thermosensitive recording layer or the thermosensitive recording material can be selected depending on the kind of the matrix resin and the type of the organic low-molecular-weight material to be employed. Examples of the solvent are tetrahydrofuran, methyl ethyl ketone, methyl isobutyl ketone, chloroform, carbon tetrachloride, ethanol, toluene and benzene. Not only when a matrix resin dispersion is used, but also when a matrix resin solution is used, the organic low-molecular-weight material is separated in the form of finely-divided particles in the matrix resin of the thermosensitive recording layer.

The matrix resin is used in thermosensitive layer in which the finely-divided particles of the low-molecular-weight material are uniformly dispersed and has a significant effect on the transparency of the layer when the recording layer assumes a maximum transparent state.

It is preferable that the matrix resin be highly dyeable with a sublimable dye and have high transparency, high mechanical stability, and excellent film-forming properties.

As such matrix resin, vinyl-chloride-based resins are most preferable.

Examples of such vinyl-chloride-based resins are polyvinyl chloride; vinyl chloride copolymers such as vinyl chloride - vinyl acetate copolymer, vinyl chloride - vinyl acetate - vinyl alcohol copolymer, vinyl chloride - vinyl acetate - maleic acid copolymer, and vinyl chloride - acrylate copolymer; polyvinylidene chloride, vinylidene chloride copolymers such as vinylidene chloride - vinyl chloride copolymer, and vinylidene chloride - acrylonitrile copolymer; polyester; polyamide; polyacrylate, polymethacrylate, and acrylate - methacrylate copolymer; and silicone resin. These resins can be employed alone or in combination.

The organic low-molecular-weight material for use in the reversible thermosensitive recording layer may be appropriately selected from the materials which are changeable from the polycrystalline state to the single crystalline state in accordance with each of the desired temperatures ranging from $T_0$ to $T_3$ as shown in FIG. 1. It is preferable that the organic low-molecular-weight material for use in the present invention have a melting point ranging from 30° to 200° C., more preferably from about 50° to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids, and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials can be employed alone or in combination.

It is preferable that the number of carbon atoms of the above-mentioned low-molecular-weight material be in the range of 10 to 60, more preferably in the range of 10 to 38, further preferably in the range of 10 to 30. Part of the alcohol groups in the esters may be saturated or unsaturated, and further may be substituted by halogen. In any case, it is preferable that the organic low-molecular-weight material have at least one atom selected from the group consisting of oxygen, nitrogen, sulfur and halogen in its molecule. More specifically, it is preferable the organic low-molecular-weight materials comprise, for instance, —OH, —COOH, —CONH, —COOR, —NH, —$NH_2$, —S—, —S—S—, —O— or a halogen atom.

Specific examples of the above-mentioned organic low-molecular-weight materials include higher fatty acids such as lactic acid, dodecanoic acid, myristic acid, pentadecanoic acid, palmitic acid, stearic acid, behenic acid, nonadecanoic acid, arachic acid, and oleic acid; esters of higher fatty acids such as methyl stearate, tetradecyl stearate, octadecyl stearate, octadecyl laurate, tetradecyl palmitate and dodecyl behenate; and the following ethers or thioethers:

$$C_{16}H_{33}-O-C_{16}H_{33},\ C_{16}H_{33}-S-C_{16}H_{33},$$

$$C_{18}H_{37}-S-C_{18}H_{37},\ C_{12}H_{25}-S-C_{12}H_{25},$$

$$C_{19}H_{39}-S-C_{19}H_{39},\ C_{12}H_{25}-S-S-C_{12}H_{25},$$

-continued

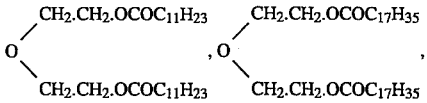

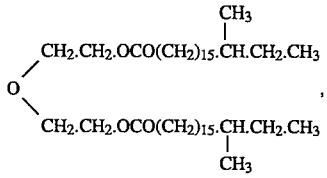

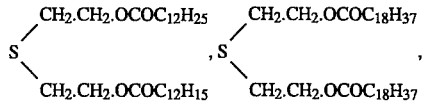

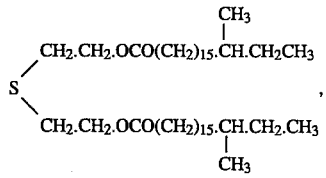

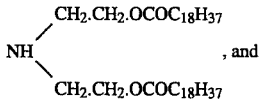

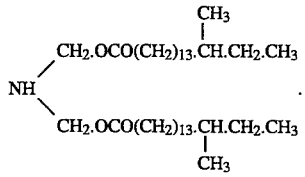

Of these, higher fatty acids having 16 or more carbon atoms, more preferably having 16 to 24 carbon atoms, such as palmimic acid, stearic acid, behenic acid, and lignoceric acid are preferred in the present invention.

It is preferable that the ratio by weight of the organic low-molecular-weight material to the matrix resin be in the range of about (2:1) to (1:16), more preferably in the range of (1:1) to (1:5) in the reversible thermosensitive recording layer. When the ratio of the low-molecular-weight material to the matrix resin is within the above range, the matrix resin can form a film in which the organic low-molecular-weight material is uniformly dispersed in the form of finely-divided particles, and the obtained recording layer can readily reach the maximum white opaque state because of the enough amount of the organic low-molecular weight material.

In the reversible thermosensitive recording layer for use in the present invention, additives such as a surface-active agent and a solvent with high boiling point can be employed to facilitate the formation of a transparent image.

Examples of she solvent with high boiling point are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, alkyl adipate 610, di-2-ethylhexyl azelate, dibutyl sebacate, di-2-ethylhexyl sebacate, diethylene glycol dibenzoate, triethylene glycol, di-2-ethyl butyrate, methyl acetylricinoleate, butyl acetylricinoleate, butylphthalyl butyl glycolate and tributyl acetylcitrate.

Examples of the surface-active agent and other additives are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil, and polypropylene glycol; acetylene glycol; sodium, calcium, barium and magnesium salts of higher alkyl benzenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; long-chain alkyl methacrylate - amine-containing monomer copolymer; styrene - maleic anhydride copolymer; and olefin - maleic anhydride copolymer.

The thermosensitive recording layer for use in the present invention may comprise a releasing agent such as amino-modified silicone, epoxy-modified silicone or alkyd-modified silicone.

The thermosensitive recording layer may further comprise a filler. Examples of the filler are white pigments such as silica, titanium oxide, and calcium carbonate.

In addition to the above, an ultraviolet-absorbing agent, and an antioxidant can also be employed for the thermosensitive recording layer of the present invention.

In the present invention, a layer containing the previously mentioned releasing agent (hereinafter referred to as a releasing layer) may be provided on the reversible thermosensitive recording layer. A variety of patterns or figures can be printed on the thermosensitive recording layer.

Such a releasing layer, preferably with a thickness in the range of 0.1 to 5 μm, can be fabricated by using as a releasing agent the previously mentioned silicone; as a binder resin having heat resistant and protective effects silicone rubber, silicone resin (as described in Japanese Laid-Open Patent Application 63-221087), polysiloxane graft polymer (as described in Japanese Laid-Open Patent Application 62-152550), ultraviolet-curing resin or electron-radiation curing resin (as described in Japanese Laid-Open Patent Application 63-310600). When any of the above-mentioned resins is for the fabrication of a releasing layer, a solvent is used for preparing a coating liquid for the provision of the releasing layer. As such a solvent, it is preferable to use a solvent in which the matrix resin and the organic low-molecular-weight material for use in the thermosensitive recording layer are not soluble or slightly soluble.

Preferable examples of such a solvent for use in the coating liquid for the releasing layer are n-hexane, and alcohols such as methyl alcohol, ethyl alcohol and isopropyl alcohol. In particular, such alcohols are preferred from the viewpoint of cost.

Each of the other layers for the information recording medium of the present invention is fabricated as follows:

A thermal transfer image receiving layer is fabricated by using a dyeable resin. When necessary, the thermal transfer image receiving layer may be composed of two or more layers overlaid.

There is no particular limitation to such a dyeable resin, but polyester, polyvinyl chloride, vinyl chloride - vinyl acetate resin are particularly preferable for use in the present invention.

A colored layer is fabricated by applying a coating liquid (solution or dispersion) which comprises as the main components a coloring agent and a binder resin to a portion where a colored layer is to be provided, and then by drying the applied coating liquid; or by simply applying a colored sheet to the above-mentioned portion.

As the coloring agent for use in the colored layer, coloring agents, pigments, and metal powders with any colors, such as red, yellow, blue, dark blue, purple, black, brown, grey, orange, and green, or with light reflecting colors such as silver, and gold, can be employed so long as the colored layer can serve as the background for the reversible thermosensitive recording layer which is situated above the colored layer by making conspicuous the changes of the transparency of the reversible thermosensitive recording layer from a transparent state to a milky white state and vice versa.

As the binder resin for use in the colored layer, varieties of thermoplastic resins, thermosetting resins, and ultraviolet-curing resins can be employed.

A light reflecting layer can be formed by depositing, for instance, aluminum on the support.

The thus provided colored layer and light reflecting layer make images formed on the reversible thermosensitive recording layer easily visible.

A magnetic layer can be provided by depositing a magnetic material by any of the conventional methods such as vacuum deposition and sputtering, or by applying a coating liquid for a magnetic layer, which comprises a magnetic material and a binder resin, and drying the applied coated liquid.

Examples of the magnetic material for the magnetic layer are iron, cobalt, nickel, and alloys and compounds of these metals.

As a binder resin for use in the magnetic layer, varieties of thermoplastic resins, thermosetting resins, and ultraviolet-curing resins can be employed.

When necessary, a shielding layer may be provided on the magnetic layer, and varieties of patterns, figures and letters can be printed on the magnetic layer.

Further, an intermediate layer can be interposed between the releasing layer (or a protective layer) and the thermosensitive recording layer to protect the thermosensitive recording layer from the solvent or a monomer component used in a coating liquid for the formation of the releasing layer (Japanese Laid-Open Patent Application 1-133781).

Examples of a resin for use in the coating liquid for the formation of the intermediate layer are the resins used as the matrix resin for the thermosensitive recording layer, and thermosetting resins and thermoplastic resins, such as polyethylene, polypropylene, polystyrene, polyvinyl alcohol, polyvinyl butyral, polyurethane, saturated polyester, unsaturated polyester, epoxy resin, phenolic resin, polycarbonate, and polyamide.

It is preferable that the intermediate layer have a thickness of about 0.1 μm to 2 μm.

As the support, a transparent or white plastic film, such as a polyester film, and paper can employed. Such film and paper may be colored.

The printing method of the present invention is a combination of (a) a printing method of superimposing a sublimation thermal image transfer recording sheet on the thermal transfer image receiving layer of an information recording medium 21 of the present invention (refer to FIG. 19), followed by the application of heat thereto by a thermal head, and (b) a reversible printing method of applying heat imagewise to a reversible thermosensitive recording layer of the information recording medium 21 by a thermal head.

These two printing methods can be carried out in any order.

When a colored layer or a light reflection layer is provided behind the reversible thermosensitive recording layer and the above-mentioned reversible thermal printing is carried out, printed images on the reversible thermosensitive recording layer can be clearly seen. The thus formed printed images are milky white images and such images can be repeatedly formed and erased as desired by the application of heat thereto.

With reference to FIGS. 19 to 22, the printing method of the present invention will now be explained in more detail.

Figure 19:
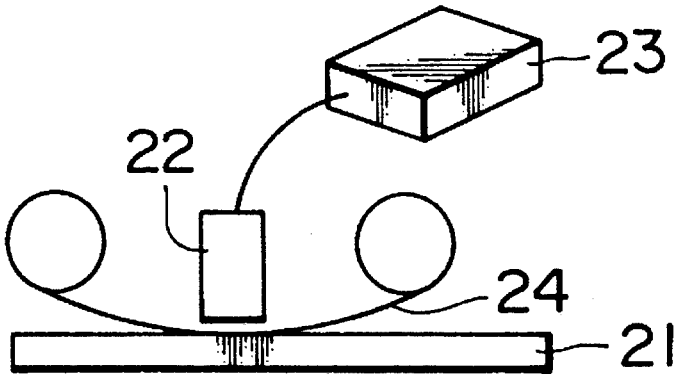
FIG. 19 is a schematic diagram of an apparatus for printing sublimation transfer images with clear full colors on the thermal transfer image receiving layer of the information recording medium of the present invention.

FIG. 19 is a schematic diagram of an apparatus for printing sublimation transfer images with clear full colors on the information recording medium 21 by superimposing a sublimation thermal transfer recording sheet (ink sheet) 24 on the thermal transfer image receiving layer of the information recording medium 21, and applying heat thereto from the side of the sublimation thermal transfer recording sheet 24 by a thermal head 22, thereby transferring a sublimable dye contained in the recording sheet 24 to the thermal transfer image receiving layer. In this figure, reference numeral 23 indicates a thermal head drive section for full color printing.

Figure 20:
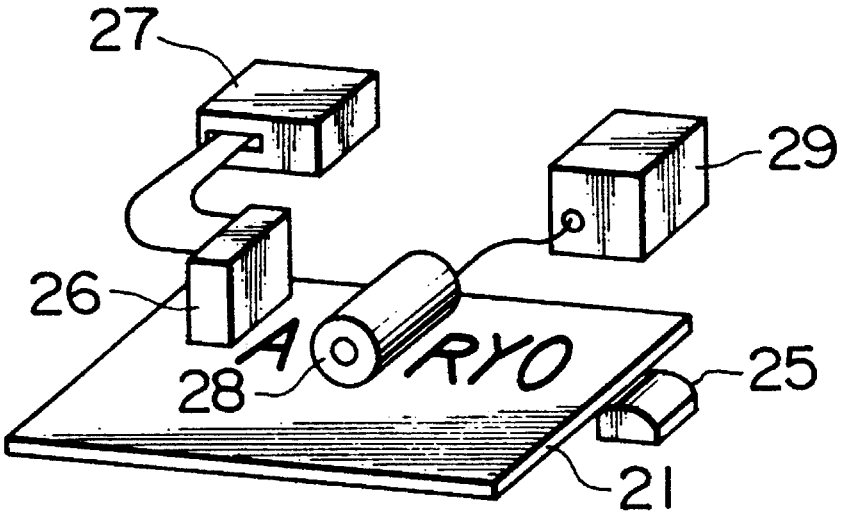
FIG. 20 is a schematic diagram of an apparatus for forming milky white images on the reversible thermosensitive recording layer of the information recording medium of the present invention.

FIG. 20 is a schematic diagram of an apparatus for forming milky white images on the reversible thermosensitive recording layer of the information recording medium 21 by the application of heat thereto by a thermal head 26, and erasing the thus formed milky white images by the application of heat by a heat roller 28. In this figure, reference numeral 25 indicates a magnetic head; reference numeral 27, a thermal head drive section for printing milky white images; and reference numeral 29, a heat roller drive section.

Figure 21:
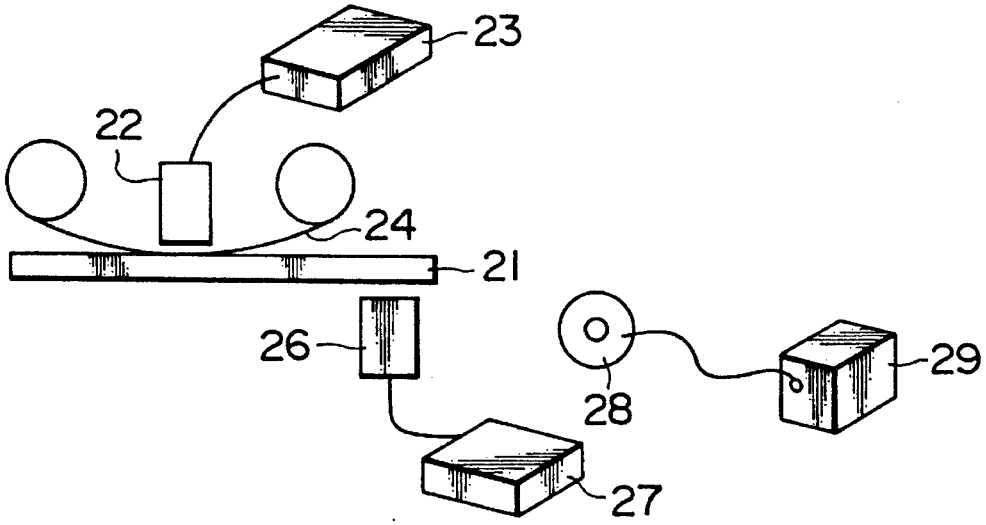

FIG. 21 is a schematic diagram of an apparatus in which the apparatus for printing sublimation transfer images on the thermal transfer image receiving layer of the information recording medium 21 shown in FIG. 19 and the apparatus for forming milky white images on the reversible thermosensitive recording layer of the information recording medium 21 shown in FIG. 20, by use of an information recording medium 21 provided with the thermal transfer image receiving layer on one side thereof, and with the reversible thermosensitive recording layer on the other side thereof.

Figure 22:
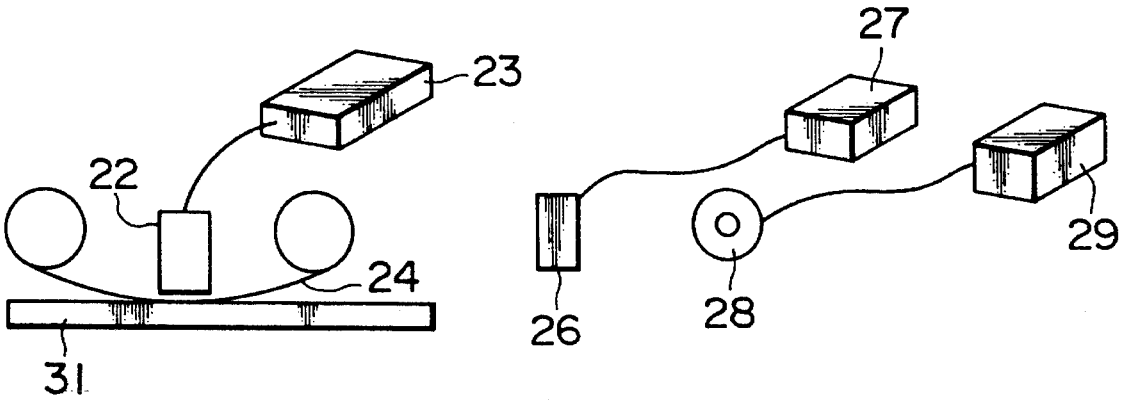
FIG. 22 is a schematic diagram of an apparatus in which the apparatus for printing sublimation transfer images on the thermal transfer image receiving layer of the information recording medium shown in FIG. 19 and the apparatus for forming milky white images on the reversible thermosensitive recording layer of the information recording medium shown in FIG. 20 are combined.

FIG. 22 is a schematic diagram of an apparatus in which the apparatus for printing sublimation transfer images on the thermal transfer image receiving layer of the information recording medium 21 shown in FIG. 19 and the apparatus for forming milky white images on the reversible thermosensitive recording layer of the information recording medium 21 shown in FIG. 20, by use of an information recording medium 31 provided with the thermal transfer image receiving layer and the reversible thermosensitive recording layer on the same side thereof.

Other features of this invention will become apparent in the course of the following description of exemplary embodiments which are given for illustration of the invention and are not intended to be limiting thereof.

EXAMPLE 1

Aluminum was deposited on part of one side of a 250 μm thick white polyester film by vacuum deposition, whereby a colored layer was provided on the polyester film.

A solution composed of the following components was coated on the colored layer:

| | Parts by weight |
|---|---|
| Behenic acid | 8 |
| Stearyl stearate | 2 |
| Di(2-ethylhexyl) phthalate | 3 |
| Vinyl chloride - vinyl acetate copolymer (Trademark "VYHH" made by Union Carbide Japan K.K.) | 25 |
| Tetrahydrofuran | 200 |

The coated solution was dried, whereby a reversible thermosensitive recording layer with a thickness of 15 μm was provided on the colored layer.

On the other side of the polyester film, opposite to the reversible thermosensitive recording layer with respect to the polyester film, a solution composed of the following components was coated:

| | Parts by weight |
|---|---|
| Polyester resin (Trademark "Vylon 200" made by Toyobo Co., Ltd.), | 20 |
| Amino-modified silicone (Trademark "SF8417", made by Toray Silicone Co., Ltd.) | 2 |
| Toluene | 40 |
| Methyl ethyl ketone | 40 |

The coated solution was dried, whereby a thermal transfer image receiving layer with a thickness of 8 μm was provided on the polyester film, whereby an information recording medium of the present invention was fabricated.

EXAMPLE 2

A solution composed of the following components was coated by a wire bar on a 10 μm thick polyester film:

| | Parts by weight |
|---|---|
| Behenic acid | 8 |
| Stearyl stearate | 2 |
| Vinyl chloride - vinyl acetate copolymer (Trademark "VYHH" made by Union Carbide Japan K.K.) | 28 |
| Tetrahydrofuran | 200 |

The coated solution was dried, whereby a reversible thermosensitive recording layer with a thickness of 10 μm was provided on the polyester film. Thus, a reversible thermosensitive recording member was fabricated.

A solution composed of the following components was coated on by a wire bar on a 10 μm thick polyester film:

| | Parts by weight |
|---|---|
| Vinyl chloride - vinyl acetate copolymer (Trademark "VYHH" made by Union Carbide Japan K.K.) | 20 |
| Amino-modified silicone (Trademark "SF8417" made by Toray Silicone Co., Ltd.) | 1 |
| Toluene | 40 |
| Methyl ethyl ketone | 40 |

The coated solution was dried, whereby a thermal transfer image receiving layer with a thickness of 6 μm was provided on the polyester film, whereby a thermal transfer image receiving member was fabricated.

A black polyester film was applied to part of one side of a commercially available magnetic card with band-shaped magnetic layers being provided thereon.

The above fabricated reversible thermosensitive recording member was applied to the black polyester film.

Furthermore, the above fabricated thermal transfer image receiving member was applied to the back side of the magnetic card, opposite to the reversible thermosensitive recording member with respect to the magnetic card, whereby an information recording medium of the present invention was fabricated.

EXAMPLE 3

A dispersion composed of the following components was coated on the bottom of a concave portion with a depth of 17 μm formed on one side of a 250 μm thick white polyester film:

| | Parts by weight |
|---|---|
| Carbon black | 10 |
| Ultraviolet-curing resin Trademark "FS-1059" made by Mitsubishi Rayon Engineering Co., Ltd.) | 5 |
| Toluene | 10 |

The coated dispersion was dried with the application of heat, and was then cured by the application of ultra-violet light by a UV lamp with a wattage of 120 W/cm for 5 seconds, whereby a colored layer with a thickness of 2 μm was provided in the concave portion of the polyester film.

The same reversible thermosensitive recording layer as employed in Example 1 was provided on the above colored layer.

On part of the same side of the polyester film as the reversible thermosensitive recording layer was provided, but in a portion of the polyester film where the reversible thermosensitive recording layer was not provided, a magnetic layer with a thickness of 10 μm was provided by coating a dispersion composed of the following components by a wire bar and then by drying the coated dispersion:

| | Parts by weight |
|---|---|
| $Fe_2O_3$ | 10 |
| Vinyl chloride - vinyl acetate copolymer (Trademark "VAGH" made by Union Carbide Japan K.K.) | 10 |
| Methyl ethyl ketone | 40 |

-continued

| | Parts by weight |
|---|---|
| Toluene | 40 |

The same thermal transfer image receiving member as fabricated in Example 1 was applied to the back side of the polyester film, opposite to the reversible thermosensitive recording layer with respect to the polyester film, whereby an information recording medium of the present invention was fabricated.

EXAMPLE 4

The same reversible thermosensitive recording layer as employed in Example 1 was provided on one side of a 250 μm thick white polyester film.

Furthermore, the same thermal transfer image receiving layer as employed in Example 1 was provided on the same side of the white polyester film as the reversible thermosensitive recording layer was provided, whereby an information recording medium of the present invention was fabricated.

EXAMPLE 5

The procedure for the fabrication of the information recording medium in Example 2 was repeated except that the thermal transfer image receiving member was applied to the same side of the magnetic card as the reversible thermosensitive recording member was applied, whereby an information recording medium of the present invention was fabricated.

EXAMPLE 6

The same colored layer as employed in Example 3 was provided in a concave portion with a depth of 17 μm formed on one side of a 250 μm thick white polyester film in the same manner as in Example 3.

On this colored layer, the same reversible thermosensitive recording layer as employed in Example 1 was provided.

The same magnetic layer as employed in Example 3 was provided on part of the back side of the polyester film, opposite to the reversible thermosensitive recording layer with respect to the polyester film.

Furthermore, the same thermal transfer image receiving member as fabricated in Example 2 was applied to the same side of the polyester film as the concave portion was formed, whereby an information recording medium of the present invention was fabricated.

The information recording media fabricated in Examples 1 through 6 were subjected to printing tests by using the apparatus shown in FIG. 19 for the formation of full color images in the thermal transfer image receiving layer, and then by using the apparatus as shown in FIG. 20 for the formation of milky white images in the reversible thermosensitive recording layer. The result was that clear full color images were formed in the thermal transfer image receiving layer of each information recording medium, and that the formation of milky white images in the reversible thermosensitive recording layer of each information recording medium and the erasure of the images were carried out without the degradation of the image quality thereof.

Furthermore, the recording of information in the magnetic recording layer of each information recording medium and the erasure thereof were also repeated. The result was that the recording and erasure performance of the magnetic layer of each information recording medium was not degraded at all during the tests.

EXAMPLE 7

Aluminum was deposited on the entire surface of one side of a 50 μm thick transparent polyester film by vacuum deposition, whereby a colored layer was formed on the transparent polyester film.

A solution composed of the following components was coated on the colored layer and dried, whereby a reversible thermosensitive recording layer with a thickness of 15 μm was formed on the colored layer, which is referred to as Film A:

| | Parts by weight |
|---|---|
| Behenic acid | 8 |
| Stearyl stearate | 2 |
| Di(2-ethylhexyl) phthalate | 3 |
| Vinyl chloride - vinyl acetate copolymer (Trademark "VYHH" made by Union Carbide Japan K.K.) | 25 |
| Tetrahydrofuran | 200 |

A solution composed of the following components was coated on the entire surface of one side of a 50 μm thick white polyester film:

| | Parts by weight |
|---|---|
| Polyester resin (Trademark "Vylon 200" made by Toyobo Co., Ltd.) | 20 |
| Amino-modified silicone (Trademark "SF8417" made by Toray Silicone Co., Ltd.) | 2 |
| Toluene | 40 |
| Methyl ethyl ketone | 40 |

The thus coated solution was dried, whereby a thermal transfer image receiving layer with a thickness of 8 μm was provided on the white polyester film, which is referred to as Film B.

The above prepared Film A was provided on one side of a transparent polyester film with a thickness of 100 μm by use of an adhesive agent, and the Film B was provided on the other side of the transparent polyester film by use of an adhesive agent, whereby an information recording medium of the present invention was fabricated.

EXAMPLE 8

A solution composed of the following components was coated on a 10 μm thick polyester film by a wire bar:

| | Parts by weight |
|---|---|
| Behenic acid | 8 |
| Stearyl stearate | 2 |
| Vinyl chloride - vinyl acetate copolymer (Trademark "VYHH" made by Union Carbide Japan K.K.) | 28 |

-continued

| | Parts by weight |
|---|---|
| Tetrahydrofuran | 200 |

The thus coated solution was dried, whereby a reversible thermosensitive recording layer was provided on the polyester film, which is referred to as Film C.

A solution composed of the following components was coated on a 10 μm thick polyester film by a wire bar:

| | Parts by weight |
|---|---|
| Vinyl chloride - vinyl acetate copolymer (Trademark "VYHH" made by Union Carbide Japan K.K.) | 20 |
| Amino-modified silicone (Trademark "SF8417" made by Toray Silicone Co., Ltd.) | 1 |
| Toluene | 40 |
| Methyl ethyl ketone | 40 |

The thus coated solution was dried, whereby a thermal transfer image receiving layer with a thickness of 6 μm was provided on the polyester film, which is referred to as Film D.

On a commercially available magnetic card with a magnetic layer on one side thereof in its entirety, a black layer was printed on part of the other side of the magnetic card, opposite to the magnetic layer with respect to the magnetic card, and the above prepared Film C was applied over the black layer, and the Film D was also applied to a portion other than the Film C on the same side of the magnetic card as the black layer was printed, whereby an information recording medium of the present invention was fabricated.

EXAMPLE 9

Aluminum was deposited on the entire surface of one side of a 100 μm thick white polyester film by vacuum deposition, whereby a colored layer was formed on the white polyester film.

Film A and Film B, which were fabricated in Example 7, were applied to the colored layer provided on the white polyester film through an adhesive layer, whereby an information recording medium of the present invention was fabricated.

EXAMPLE 10

The same reversible thermosensitive recording layer as prepared in Example 8 was provided on a colored layer, which was formed by vacuum deposition of aluminum on part of a 10 μm thick polyester film, whereby Film C' was fabricated.

The same thermal transfer image receiving layer with a thickness of 6 μm provided on a polyester film with a thickness of 10 μm was fabricated, which is the same as Film D as fabricated in Example 8.

The above prepared Film C' was applied to the back side of a commercially available IC card of an IC chip buried type, with the colored layer thereof covering about ⅓ the total bottom area of the applied Film C' and the remaining bottom area of the applied Film C' being free from the colored layer, and the Film D was applied to the remaining portion of the back side of the IC card, whereby an information recording medium of the present invention was fabricated.

EXAMPLE 11

A nitrile-rubber-based adhesive agent (Trademark "EC776" made by Sumitomo 3M Ltd. ) was applied to the back side of Film A fabricated in Example 7 in a card-size area (about 86×55 mm), with an area of about 25×40 mm therein being maintained as a vacant non-adhesive portion, whereby a reversible thermosensitive recording label sheet for use in the present invention was prepared.

The same adhesive agent as mentioned above was applied to the entire surface of the back side of Film B fabricated in Example 7, whereby a thermal transfer image receiving label sheet for use in the present invention was prepared.

The thermal transfer image receiving label sheet using Film B was applied to a front surface of a commercially available IC card.

On the back side of the IC card, a black printed layer with an area of about 24×39 mm was provided, and the reversible thermosensitive recording label sheet using Film A was applied onto the black printed layer in such a manner that the vacant non-adhesive portion of the reversible thermosensitive recording label sheet was fittingly superimposed on the black printed layer, whereby an information recording medium of the present invention was fabricated.

The information recording media fabricated in Examples 7 through 11 were subjected to printing tests by using the apparatus shown in FIG. 19 for the formation of full color images in the thermal transfer image receiving layer, and by using the apparatus as shown in FIG. 20 for the formation of milky white images in the reversible thermosensitive recording layer. The result was that clear full color images were formed in the thermal transfer image receiving layer of each information recording medium, and that the formation of milky white images in the reversible thermosensitive recording layer of each information recording medium and the erasure of the images were carried out with substantially no degradion of the image quality thereof even when the erasure was repeated 100 times.

EXAMPLE 12

Aluminum was deposited on part of one side of a 250 μm thick white polyester film by vacuum deposition, whereby a colored layer was provided on the polyester film.

A solution composed of the following components was applied to the above provided colored layer:

| | Parts by weight |
|---|---|
| Behenic acid | 8 |
| Stearyl stearate | 2 |
| Di(2-ethylhexyl) phthalate | 3 |
| Vinyl chloride - vinyl acetate copolymer (Trademark "VYHH" made by Union Carbide Japan K.K.) | 25 |
| Amino-modified silicone (Trademark "SF8417" made by Toray Silicone Co., Ltd.) | 2 |
| Tetrahydrofuran | 200 |

The thus coated solution was dried, whereby a sublimable material receiving reversible thermosensitive recording layer with a thickness of 15 μm was provided on the polyester film. Thus, an information recording medium of the present invention was fabricated.

EXAMPLE 13

A solution composed of the following components was coated on a 50 μm thick polyester film by a wire bar:

| | Parts by weight |
|---|---|
| Behenic acid | 8 |
| Stearyl stearate | 2 |
| Vinyl chloride - vinyl acetate copolymer (Trademark "VYHH" made by Union Carbide Japan K.K.) | 28 |
| Amino-modified silicone (Trademark "SF8417" made by Toray Silicone Co., Ltd.) | 2 |
| Tetrahydrofuran | 200 |

The thus coated solution was dried, whereby a sublimable material receiving reversible thermosensitive recording layer with a thickness of 10 μm was provided on the polyester film. Thus, a reversible thermosensitive recording member was fabricated.

A nitrile-rubber-based adhesive agent (Trademark "EC776" made by Sumitomo 3M Ltd.) was applied to the back side of the above fabricated sublimable material receiving reversible thermosensitive recording member, whereby an adhesive layer with a thickness of about 40 μm was provided thereon.

A disposable backing sheet was applied to the above adhesive layer, so that a sublimable material receiving reversible thermosensitive recording label sheet with a desired size was prepared by cutting.

On a commercially available magnetic card with a magnetic layer on one side thereof in its entirety, a black polyester film was applied to part of the other side of the magnetic card, opposite to the magnetic layer with respect to the magnetic card, and the above prepared sublimable material receiving reversible thermosensitive recording label sheet was applied, with the elimination of the disposable backing sheet, to the same side of the magnetic card as the black polyester film was applied, whereby an information recording medium of the present invention was fabricated.

EXAMPLE 14

A dispersion composed of the following components was coated on the bottom of a concave portion with a depth of 17 μm formed on one side of a 250 μm thick white polyester film:

| | Parts by weight |
|---|---|
| Carbon black | 10 |
| Ultraviolet-curing resin (Trademark "FS-1059" made by Mitsubishi Rayon Engineering Co., Ltd.) | 5 |
| Toluene | 10 |

The coated dispersion was dried with the application of heat, and was then cured by the application of ultraviolet light by a UV lamp with a wattage of 120 W/cm for 5 seconds, whereby a colored layer with a thickness of 2 μm was provided in the concave portion of the polyester film.

The same reversible thermosensitive recording layer as employed in Example 12 was provided on the above colored layer.

On the other side of the polyester film, opposite to the reversible thermosensitive recording layer, a magnetic layer with a thickness of 10 μm was provided by coating a dispersion composed of the following components by a wire bar and then by drying the coated dispersion:

| | Parts by weight |
|---|---|
| $Fe_2O_3$ | 10 |
| Vinyl chloride - vinyl acetate copolymer (Trademark "VAGH" made by Union Carbide Japan K.K.) | 10 |
| Methyl ethyl ketone | 40 |
| Toluene | 40 |

Thus, an information recording medium of the present invention was fabricated.

EXAMPLE 15

Aluminum was deposited on part of one side of a 250 μm thick white polyester film by vacuum deposition, whereby a colored layer was provided on the polyester film.

A solution composed of the following components was applied to the above provided colored layer:

| | Parts by weight |
|---|---|
| Behenic acid | 8 |
| Stearyl stearate | 2 |
| Di(2-ethylhexyl) phthalate | 3 |
| Vinyl chloride - vinyl acetate copolymer (Trademark "VYHH" made by Union Carbide Japan K.K.) | 25 |
| Tetrahydrofuran | 200 |

The thus coated solution was dried, whereby a reversible thermosensitive recording layer with a thickness of 14 μm was provided on the polyester film.

A solution composed of the following components, when necessary, appropriately diluted, was applied to the reversible thermosensitive recording layer:

| | Parts by weight |
|---|---|
| Solution of urethane acrylate ultraviolet-curing resin (Content of solid components: 75 wt. %) (Trademark "Unidic C7-157" made by Dainippon Ink & Chemical, Incorporated) | 100 |
| Amino-modified silicone (Trademark "SF8417", made by Toray Silicone Co., Ltd.) | 3 |

The applied solution was dried with the application of heat thereto, and was then cured by the application of ultra-violet light by a UV lamp with a wattage of 80 W/cm for 3 seconds, whereby a releasing layer with a thickness of about 1 μm was provided on the reversible thermosensitive recording layer, whereby an information recording medium of the present invention was fabricated.

EXAMPLE 16

A solution composed of the following components was coated by a wire bar on a colored layer which was formed by vacuum deposition of aluminum on part of a 10 μm thick polyester film:

| | Parts by weight |
|---|---|
| Behenic acid | 8 |
| Stearyl stearate | 2 |
| Vinyl chloride - vinyl acetate copolymer (Trademark "VYHH" made by Union Carbide Japan K.K.) | 28 |
| Amino-modified silicone (Trademark "SF8417" made by Toray Silicone Co., Ltd.) | 2 |
| Tetrahydrofuran | 200 |

The thus coated solution was dried, whereby a sublimable material receiving reversible thermosensitive recording layer with a thickness of 10 μm was provided on the polyester film. Thus, a reversible thermosensitive recording member was fabricated.

A nitrile-rubber-based adhesive agent (Trademark "EC776" made by Sumitomo 3M Ltd.) was applied to the back side of the above fabricated reversible thermosensitive recording member, whereby an adhesive layer with a thickness of about 40 μm was provided thereon.

A disposable backing sheet was applied to the adhesive layer, so that a reversible thermosensitive recording label sheet with a desired size was prepared by cutting.

The above prepared reversible thermosensitive recording label sheet was applied to the back side of a commercially available IC card of an IC chip buried type, with the colored layer thereof covering about ⅓ the total bottom area of the applied reversible thermosensitive recording label sheet and the remaining bottom area of the reversible thermosensitive recording label sheet being free from the colored layer, whereby an information recording medium of the present invention was fabricated.

EXAMPLE 17

A 500 μm thick polyvinyl chloride film card with a concave portion with an area of 25×40 mm and a depth of 17 μm formed on the back side thereof and magnetic stripes provided on the back side thereof was prepared.

The reversible thermosensitive recording label sheet fabricated in Example 16 was applied to the bottom of the concave formed on the back side of the polyvinyl chloride film card, whereby an information recording medium of the present invention was fabricated.

EXAMPLE 18

A solution composed of the following components was applied to a 50 μm thick transparent polyester film:

| | Parts by weight |
|---|---|
| Behenic acid | 8 |
| Stearyl stearate | 2 |
| Di(2-ethylhexyl) phthalate | 3 |
| Vinyl chloride - vinyl acetate copolymer (Trademark "VYHH" made by Union Carbide Japan K.K.) | 25 |

-continued

| | Parts by weight |
|---|---|
| Tetrahydrofuran | 200 |

The thus coated solution was dried, whereby a reversible thermosensitive recording layer with a thickness of 14 μm was provided on the polyester film.

A solution composed of the following components, when necessary, appropriately diluted, was applied to the reversible thermosensitive recording layer:

| | Parts by weight |
|---|---|
| Solution of urethane acrylate ultraviolet-curing resin (Content of solid components: 75 wt. %) (Trademark "Unidic C7-157" made by Dainippon Ink & Chemical, Incorporated) | 100 |
| Amino-modified silicone (Trademark "SF8417", made by Toray Silicone Co., Ltd.) | 3 |

The solution applied was dried with the application of heat thereto, and was then cured by the application of ultraviolet light by a UV lamp with a wattage of 80 W/cm for 3 seconds, whereby a releasing layer with a thickness of about 1 μm was provided on the reversible thermosensitive recording layer. Thus, a reversible thermosensitive recording member for use in the present invention was fabricated.

A nitrile-rubber-based adhesive agent (Trademark "EC776" made by Sumitomo 3M Ltd.) was applied to the back side of the above fabricated reversible thermosensitive recording member in a card-size area (about 86×55 mm), with an area of about 25×40 mm therein being maintained as a non-adhesive, vacant portion, whereby a reversible thermosensitive recording label sheet provided with an adhesive layer with a thickness of about 40 μm for use in the present invention was prepared.

A disposable backing sheet was applied to the adhesive layer, so that a reversible thermosensitive recording label sheet with a desired size was prepared by cutting.

On part of the back side of a commercially available IC card of an IC chip buried type, a black printed layer with an area of about 24×39 mm was provided, and the above prepared reversible thermosensitive recording label sheet was applied onto the black printed layer in such a manner that the vacant non-adhesive portion of the reversible thermosensitive recording label sheet was fittingly superimposed on the black printed layer, whereby an information recording medium of the present invention was fabricated.

The information recording media fabricated in Examples 12 through 18 of the present invention were subjected to printing tests by using the apparatus shown in FIG. 19 for the formation of full color images in the thermal transfer image receiving layer, and by using the apparatus as shown in FIG. 20 for the formation of milky white images in the reversible thermosensitive recording layer. The result was that clear full color images were formed in the thermal transfer image receiving layer of each information recording medium, and that the formation of milky white images in the reversible thermosensitive recording layer of each information recording medium and the erasure of the images were carried out with substantially no degradion of the image quality thereof even when the erasure was repeated 100 times.

The information recording medium of the present invention includes a reversible thermosensitive recording layer whose transparency reversibly changes depending upon the temperature thereof, so that information can be displayed with high contrast, easily at low cost, and the displayed information is not erased easily by friction.

Furthermore, according to the present invention, clear full color images such as photographs, illustrations and pictures can be formed on an identical side, the back side of the reversible thermosensitive recording layer, or around the reversible thermosensitive recording layer.

What is claimed is:

1. An information recording medium comprising:

a support;

a thermosensitive recording layer provided at least on one side of said support, said thermosensitive recording layer comprising a matrix resin and an organic low-molecular-weight material which is dispersed in said matrix resin, the transparency of said thermosensitive recording layer being reversibly changeable depending upon the temperature thereof; and a thermal transfer image receiving layer for thermal printing thereon by thermal transfer recording, which is provided at least on one side of said support, opposite to said thermosensitive recording layer.

2. The information recording medium as claimed in claim 1, further comprising a colored layer or a light reflection layer which is provided between said thermosensitive recording layer and said support, in a portion right under said thermosensitive recording layer.

3. The information recording medium as claimed in claim 2, wherein said colored layer or said light reflection layer is provided between said thermosensitive recording layer and said support through an adhesive layer which includes a vacant non-adhesive portion.

4. The information recording medium as claimed in claim 1, further comprising a colored layer or a light reflection layer which is provided on the back side of said support, opposite to said thermosensitive recording layer with respect to said support, wherein a line passing through said support, perpendicular to said support, will intersect both said thermosensitive recording layer, and said colored layer or said light reflection layer.

5. The information recording medium as claimed in claim 4, wherein said colored layer or said light reflection layer is provided on the back side of said support through an adhesive layer which includes a vacant non-adhesive portion.

6. The information recording medium as claimed in claim 1, further comprising a magnetic recording layer on part of at least one side of said support.

7. The information recording medium as claimed in claim 1, further comprising an IC on part of at least one side of said support or within said support.

8. The information recording medium as claimed in claim 1, wherein said thermosensitive recording layer further comprises a releasing agent.

9. The information recording medium as claimed in claim 1, further comprising a releasing layer which is provided on said thermosensitive recording layer.

10. The information recording medium as claimed in claim 1, wherein said support includes a concave portion on at least one side thereof in which said thermosensitive recording layer is provided.

11. An information recording medium comprising:

a support;

a thermosensitive recording layer supported on a film which is applied to at least one side of said support, said thermosensitive recording layer comprising a matrix resin and an organic low-molecular-weight material which is dispersed in said matrix resin, the transparency of said thermosensitive recording layer being reversibly changeable depending upon the temperature thereof, and a thermal transfer image receiving layer for thermal printing thereon by thermal transfer recording, supported on a film which is applied to at least one side of said support.

12. The information recording medium as claimed in claim 11, further comprising a colored layer or a light reflection layer which is provided between said film on which said thermosensitive recording layer is provided and said support, in a portion right under said thermosensitive recording layer.

13. The information recording medium as claimed in claim 12, wherein said colored layer or said light reflection layer is provided between said thermosensitive recording layer and said support through an adhesive layer which includes a vacant non-adhesive portion.

14. The information recording medium as claimed in claim 11, further comprising a colored layer or a light reflection layer which is provided on the back side of said support, opposite to said thermosensitive recording layer with respect to said support, in a portion under said thermosensitive recording layer.

15. The information recording medium as claimed in claim 14, wherein said colored layer or said light reflection layer is provided on the back side of said support through an adhesive layer which includes a vacant non-adhesive portion.

16. The information recording medium as claimed in claim 11, further comprising a magnetic recording layer on part of at least one side of said support.

17. The information recording medium as claimed in claim 11, further comprising an IC on part of at least one side of said support or within said support.

18. The information recording medium as claimed in claim 11, wherein said thermosensitive recording layer further comprises a releasing agent.

19. The information recording medium as claimed in claim 11, further comprising a releasing layer which is provided on said thermosensitive recording layer.

20. The information recording medium as claimed in claim 11, wherein said support includes a concave portion on at least one side thereof in which said thermosensitive recording layer supported by said film is provided.

21. A printing method of printing a sublimation transfer image and a milky-white image on an information recording medium, which comprises (a) a support; (b) a thermosensitive recording layer provided at least on one side of support, said thermosensitive recording layer comprising a matrix resin and an organic low-molecular-weight material which is dispersed in said matrix resin, the transparency of said thermosensitive recording layer being reversibly changeable depending upon the temperature thereof; (c) a thermal transfer image receiving layer for thermal printing thereon by thermal transfer recording, which is provided at least on one side of said support, opposite to said thermosensitive recording layer; and (d) a colored layer or a light reflection layer which is provided between said thermosensitive recording layer and said support, in a portion right under said thermosensitive recording layer, comprising the steps of:

superimposing a sublimation thermal image transfer recording sheer on said thermal transfer image receiving layer of said information recording medium;

applying heat imagewise to said sublimation thermal image transfer recording sheet, thereby printing a sublimation transfer image on said thermal transfer image receiving layer, and applying heat imagewise to a portion of said thermosensitive recording layer above said colored layer or said light reflection layer, thereby printing a milky-white image on said portion of said thermosensitive recording layer.

22. The printing method as claimed in claim 21, wherein said milky-white image is repeatedly printed or erased by the application of heat no said portion of said thermosensitive recording layer.

23. A printing method of printing a sublimation transfer image and a milky-white image on an information recording medium, which comprises (a) a support; (b) a thermosensitive recording layer supported on a film which is applied to at least one side of said support, said thermosensitive recording layer comprising a matrix resin and an organic low-molecular-weight material which is dispersed in said matrix resin, the transparency of said thermosensitive recording layer being reversibly changeable depending upon the temperature thereof; (c) a thermal transfer image receiving layer for thermal printing thereon by thermal transfer recording, supported on a film which is applied to at least one side of said support; and (d) a colored layer or a light reflection layer which is provided between said film on which said thermosensitive recording layer is provided and said support, in a portion right under said thermosensitive recording layer, comprising the steps of:

superimposing a sublimation thermal image transfer recording sheet on said thermal transfer image receiving layer of said information recording medium;

applying heat imagewise to said sublimation thermal image transfer recording sheet, thereby printing a sublimation transfer image on said thermal transfer image receiving layer, and applying heat imagewise to a portion of said thermosensitive recording layer above said colored layer or said light reflection layer, thereby printing a milky-white image on said portion of said thermosensitive recording layer.

24. The printing method as claimed in claim 23, wherein said milky-white image is repeatedly printed or erased by the application of heat to said portion of said thermosensitive recording layer.

25. A printing method of printing a sublimation transfer image and a milky-white image on an information recording medium, which comprises (a) a support; (b) a thermosensitive recording layer provided at least on one side of said support, said thermosensitive recording layer comprising a matrix resin and an organic low-molecular-weight material which is dispersed in said matrix resin, the transparency of said thermosensitive recording layer being reversibly changeable depending upon the temperature thereof; (c) a thermal transfer image receiving layer for thermal printing thereon by thermal transfer recording, which is provided at least on one side of said support, opposite to said thermosensitive recording layer; and (d) a colored layer or a light reflection layer which is provided on the back side of said support, opposite to said thermosensitive recording layer with respect to said support, wherein a line passing through said support, perpendicular to said support, will intersect both said thermosensitive recording layer, and said colored layer or said light reflection layer, comprising the steps of:

superimposing a sublimation thermal image transfer recording sheet on said thermal transfer image receiving layer of said information recording medium;

applying heat imagewise to said sublimation thermal image transfer recording sheet, thereby printing a sublimation transfer image on said thermal transfer image receiving layer, and applying heat imagewise to a portion of said thermosensitive recording layer above said colored layer or said light reflection layer, thereby printing a milky-white image on said portion of said thermosensitive recording layer.

26. The printing method as claimed in claim 25, wherein said milky-white image is repeatedly printed or erased by the application of heat to said portion of said thermosensitive recording layer.

27. A printing method of printing a sublimation transfer image and a milky-white image on an information recording medium, which comprises (a) a support; (b) a thermosensitive recording layer supported on a film which is applied to at least one side of said support, said thermosensitive recording layer comprising a matrix resin and an organic low-molecular-weight material which is dispersed in said matrix resin, the transparency of said thermosensitive recording layer being reversibly changeable depending upon the temperature thereof; (c) a thermal transfer image receiving layer for thermal printing thereon by thermal transfer recording, supported on a film which is applied to at least one side of said support; and (d) a colored layer or a light reflection layer which is provided on the back side of said support, opposite to said thermosensitive recording layer with respect to said support, in a portion under said thermosensitive recording layer, comprising the steps of:

superimposing a sublimation thermal image transfer recording sheet on said thermal transfer image receiving layer of said information recording medium;

applying heat imagewise to said sublimation thermal image transfer recording sheet, thereby printing a sublimation transfer image on said thermal transfer image receiving layer, and applying heat imagewise to a portion of said thermosensitive recording layer above said colored layer or said light reflection layer, thereby printing a milky-white image on said portion of said thermosensitive recording layer.

28. The printing method as claimed in claim 27, wherein said milky-white image is repeatedly printed or erased by the application of heat to said portion of said thermosensitive recording layer.

29. A printing method of printing a sublimation transfer image and a milky-white image on an information recording medium, which comprises (i) a support; (ii) a sublimable material receiving thermosensitive recording layer provided at least on one side of said support, said sublimable material receiving thermosensitive recording layer comprising (a) a matrix resin having a function of receiving a thermosensitive sublimable material, and (b) an organic low-molecular-weight material which is dispersed in said matrix resin, the transparency of said sublimable material receiving thermosensitive recording layer being reversibly changeable depending upon the temperature thereof; and (iii) a colored layer or a light reflection layer which is provided between said sublimable material receiving thermosensitive recording layer and said support, in a portion right under said sublimable material receiving thermosensitive recording layer, comprising the steps of:

superimposing a sublimation thermal image transfer recording sheet on said sublimable material receiving thermosensitive recording layer of said information recording medium;

applying heat imagewise to said sublimation thermal image transfer recording sheet, thereby printing a sublimation transfer image on said sublimable material receiving thermosensitive recording layer, and applying heat imagewise to a portion of said sublimable material receiving thermosensitive recording layer above said colored layer or said light reflection layer, thereby printing a milky-white image on said portion of said sublimable material receiving thermosensitive recording layer.

30. The printing method as claimed in claim 29, wherein said milky-white image is repeatedly printed or erased by the application of heat to said portion of said thermosensitive recording layer.

* * * * *